US007108150B1

(12) United States Patent
Rouse et al.

(10) Patent No.: US 7,108,150 B1
(45) Date of Patent: Sep. 19, 2006

(54) TRASH RECEPTACLE UNIT

(76) Inventors: Jason C. Rouse, P.O. Box 156, Green City, MO (US) 63545; Lindsey Jo Rouse, P.O. Box 156, Green City, MO (US) 63545

( * ) Notice: Subject to any disclaimer, the term of this patent is extended or adjusted under 35 U.S.C. 154(b) by 64 days.

(21) Appl. No.: 10/905,645

(22) Filed: Jan. 14, 2005

(51) Int. Cl.
*B65D 8/00* (2006.01)
*B65D 8/04* (2006.01)

(52) U.S. Cl. ..... 220/625; 220/908; 220/345.1; 220/345.4; 220/504

(58) Field of Classification Search ..... 220/345.4, 220/345.1, 254.9, 740, 625, 916, 729, 351, 220/908, 908.1, 495.07, 504; 248/97–99, 248/146, 148, 149, 154
See application file for complete search history.

(56) References Cited

U.S. PATENT DOCUMENTS 1,598,135 A 8/1926 Heinson et al.
2,877,923 A * 3/1959 Perez ..... 220/561
2,926,923 A 3/1960 Browne
3,115,986 A * 12/1963 Grof ..... 220/495.08
3,647,102 A * 3/1972 Cooley ..... 220/495.08
3,854,649 A * 12/1974 Wagner et al. ..... 220/345.1
3,915,360 A * 10/1975 Leger et al. ..... 222/538
4,653,669 A * 3/1987 Von Holdt ..... 222/90
4,905,945 A 3/1990 Peterson
4,913,309 A * 4/1990 Fink ..... 220/23.83
4,923,080 A * 5/1990 Lounsbury ..... 220/600
4,930,653 A 6/1990 Machado
5,213,294 A 5/1993 DeBord
5,358,138 A * 10/1994 Karwoski ..... 220/495.11
5,967,362 A 10/1999 Corbin
6,298,885 B1 * 10/2001 Yoshino et al. ..... 141/114
2003/0005617 A1 * 1/2003 Holverson ..... 43/41

* cited by examiner

*Primary Examiner*—Nathan J. Newhouse
*Assistant Examiner*—Eugene Lhymn
(74) *Attorney, Agent, or Firm*—Donald R. Schoonover

(57) ABSTRACT

A tubular member is releasably mounted on a base and encircles a trash bag that rests on the base. Once the trash bag is filled, the tubular member is released from the base and removed from the filled trash bag. The filled trash bag can then be removed and discarded.

2 Claims, 1 Drawing Sheet

TRASH RECEPTACLE UNIT

BACKGROUND OF THE INVENTION

The present invention relates to the general art of receptacles, and to the particular field of horizontally attached receptacles which can be detached.

Many people use trash bags to store trash. Generally, these trash bags must be placed into a trash container, filled and then removed for disposal. To this end, the inventor is aware of several different types of trash bags and trash receptacles that use trash bags.

However, one problem that the inventor has identified is the difficulty in placing a new trash bag into a container and then removing a full bag from the container. Often, air pressure and suction make removing a filled trash bag from a container difficult. This is especially a problem if the bag is heavy or bulky and/or the person is disabled.

Therefore, there is a need for a trash receptacle that can be easily manipulated.

In some situations, a filled trash bag is quite heavy, and, in fact, may be heavier than the container itself. Therefore, removing a filled trash bag from a container may be difficult and cumbersome. Still further, placing an empty bag into a trash container may be difficult and onerous. While the inventor is aware of some trash containers that have units for storing and dispensing trash bags, these containers really do not solve the problem as a user must still reach into a trash container to deploy a fresh bag and then still must wrestle with a filled bag to remove that filled bag from the container.

Therefore, there is a further need for such a trash receptacle that can be used in connection with a trash bag which can be easily placed and removed.

Often, a trash container becomes soiled and must be cleaned. This is generally accomplished by spraying water into the container. This water must then be dumped out which requires lifting or at least manipulating the container. This can be difficult if the person is disabled in any way. At any rate, this is an inefficient way to clean such containers.

Therefore, there is a need for a trash receptacle that can be easily and efficiently cleaned.

One problem with many of the trash containers known to the inventor is the stability thereof. In windy conditions, some of these containers tend to tip over and spill. Some containers include heavy bases to prevent tipping. However, such bases make the containers difficult to handle and manipulate, especially when removing a trash bag or cleaning the container.

Therefore, there is a need for a trash receptacle that is stable yet easy to manipulate.

PRINCIPAL OBJECTS OF THE INVENTION

It is a main object of the present invention to provide a trash receptacle that can be easily manipulated.

It is another object of the present invention to provide a trash receptacle that can be used in connection with a trash bag which can be easily placed and removed.

It is another object of the present invention to provide a trash receptacle that can be easily and efficiently cleaned.

It is another object of the present invention to provide a trash receptacle that is stable yet easy to manipulate.

SUMMARY OF THE INVENTION

These, and other, objects are achieved by a trash receptacle unit which includes a base on which a tubular member is releasably mounted. The tubular member has a movable handle and will encircle a trash bag that rests on the base. Once the tubular member is in place encircling the trash bag, the tubular member is releasably attached to the base. Trash is then placed into the bag that is located within the tubular member. Once the trash bag is filled, the tubular container is released from the base and withdrawn from the filled trash bag that remains in place on the base. The filled trash bag can then be removed for disposal.

Using the trash receptacle unit embodying the present invention will permit the container to be easily manipulated for loading, unloading and cleaning. The heavy base provides stability, but since the tubular member is removed from the heavy base, the heavy base will not interfere with movement of the trash bag. A trash bag can be easily placed and removed for disposal.

BRIEF DESCRIPTION OF THE DRAWING FIGURES

DETAILED DESCRIPTION OF THE PREFERRED EMBODIMENT

Figure 2:
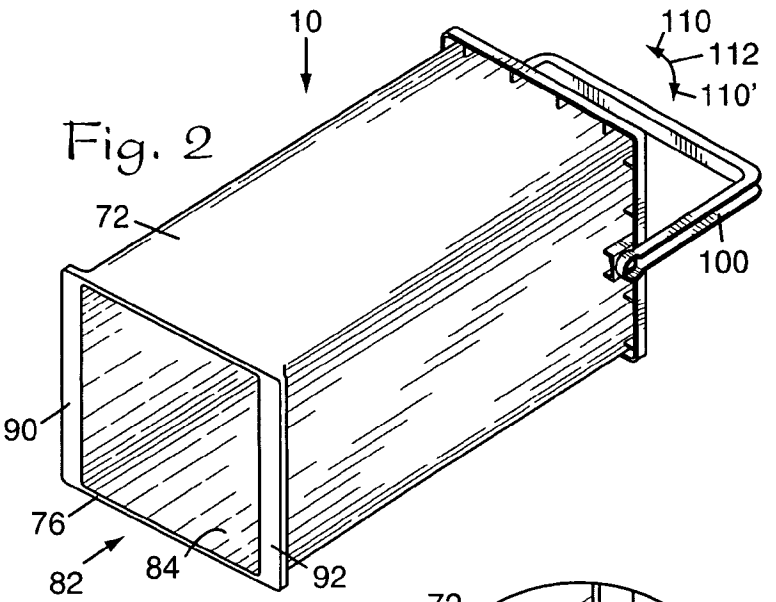
FIG. 2 is a perspective view of a tubular member which is included in the trash receptacle unit embodying the present invention.
Figure 3:
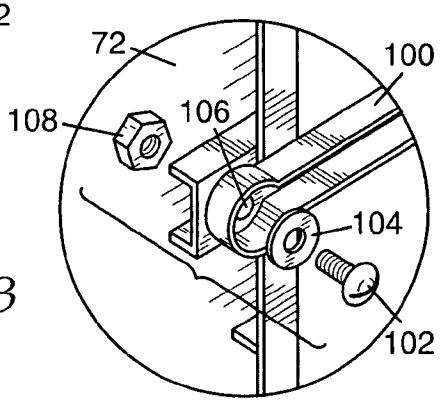
FIG. 3 is a detail view of a handle unit on the tubular member.
Figure 1:
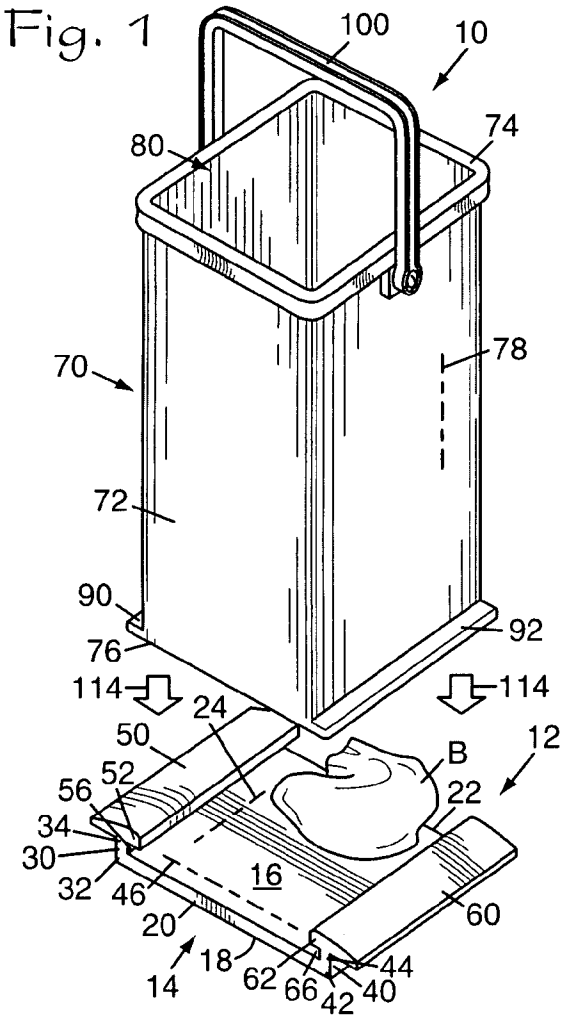
FIG. 1 is an exploded perspective view of a trash receptacle unit embodying the present invention.

Other objects, features and advantages of the invention will become apparent from a consideration of the following detailed description and the accompanying drawings.

Referring to the Figures, it can be understood that the present invention is embodied in a trash receptacle unit 10 that achieves the above-stated objectives.

Unit 10 comprises a base member 12 which includes a U-shaped body 14. Body 14 includes a first surface 16, which is a top surface when base member 12 is in use, and a second surface 28, which is a bottom surface when base member 12 is in use. Base member 12 further includes a first side wall 20, a second side wall 22, and a transverse axis 24 which extends between first side wall 20 and second side wall 22.

A first end wall 30 has a proximal end 32, which is unitary with first surface 16, and a distal end 34, which is spaced apart from first surface 16. A second end wall 40 has a proximal end 42, which is unitary with first surface 16, and a distal end 44, which is spaced apart from first surface 16.

A longitudinal axis 46 extends between the first end wall 30 and the second end wall 40.

A first wing 50 is unitary with distal end 34 of first end wall 30 and is oriented to extend essentially parallel to first surface 16. First wing 50 includes a portion 52 that extends from first end wall 30 toward second end wall 40 and extends over first surface 16.

A first channel 56 is defined between first surface 16 and portion 52 of first wing 50.

A second wing 60 is unitary with distal end 44 of second end wall 40 and is oriented to extend essentially parallel to first surface 16. Second wing 60 includes a portion 62 that extends from second end wall 40 toward first end wall 30 and extends over first surface 16.

A second channel 66 is defined between first surface 16 and portion 62.

A tubular member 70 is releasably mounted on base member 12 when in use.

Member 70 includes a tubular side wall 72 which has a first end 74, which is a top end when tubular member 70 is in use, and a second end 76, which is a bottom end when tubular member 70 is in use. A longitudinal axis 78 extends between first end 74 and second end 76. Tubular side wall 72 is open adjacent to first end 74 to define an opening 80 and adjacent to second end 76 to define an opening 82. A bore 84 is defined through tubular side wall 72 and extends from first end 74 to second end 76.

A first wing 90 is unitary with second end 76 of tubular side wall 72 and extends outwardly from the tubular side wall 72 and is slidably received in first channel 56 when tubular member 70 is in use. A second wing 92 is unitary with second end 76 of tubular side wall 72 and extends outwardly from the tubular side wall 72 and is slidably received in second channel 66 when tubular member 70 is in use.

A handle 100 is pivotally attached to tubular member 70 adjacent to first end 74 by a pivot pin 102 extending through a washer 104 and through a pivot pin-accommodating hole 106 defined through side wall 72. A nut 108 fixes pivot pin 102 to side wall 72 so handle 100 can move in directions 110 and 110' indicated by the double-headed arrow 112.

As can be understood by those skilled in the art based on the teaching of the present disclosure, use of unit 10 is as follows. A trash bag B is located on surface 16 of base member 12, and tubular unit 70 is dropped down over that bag as indicated by arrows 114. Tubular member 70 is then manipulated to slide wings 90 and 92 into channels 56 and 66 respectively. The bag is thus securely encircled by tubular member 70 and both tubular member 70 and the bag are held in position in a stable and non-tip manner. When the trash bag is full, tubular member 70 is maneuvered so wings 90 and 92 are slid out of channels 56 and 66, and the tubular member is lifted off of the bag to expose the bag. The bag is then removed. Tubular member 70 and base member 12 can be easily cleaned as required. Base member 12 can be heavy since it does not have to be moved and thus unit 10 can be stable without requiring a person to move or manipulate a heavy item such as member 12.

It is understood that while certain forms of the present invention have been illustrated and described herein, it is not to be limited to the specific forms or arrangements of parts described and shown.

What is claimed is:

1. A trash receptacle unit comprising:

(a) a base member which includes (1) a U-shaped body having (A) a first surface which is a top surface when said base member is in use, (B) a second surface which is a bottom surface when said base member is in use, (C) a first side wall, (D) a second side wall, (E) a transverse axis which extends between the first side wall and the second side wall, (F) a first end wall having a proximal end unitary with the first surface and a distal end spaced apart from the first surface, (G) a second end wall having a proximal end unitary with the first surface and a distal end spaced apart from the first surface, and (H) a longitudinal axis which extends between the first end wall and the second end wall, (2) a first wing which is unitary with the distal end of the first end wall and which is oriented to extend essentially parallel to the first surface and which includes a portion that extends from the first end wall toward the second end wall and extends over the first surface, (3) a first channel defined between the first surface and the portion of the first wing that extends over the first surface, (4) a second wing which is unitary with the distal end of the second end wall and which is oriented to extend essentially parallel to the first surface and which includes a portion that extends from the second end wall toward the first end wall and extends over the first surface, and (5) a second channel defined between the first surface and the portion of the second wing that extends over the first surface;

(b) a tubular member which is releasably mounted on said base member when in use and which includes (1) a tubular side wall having a first end which is a top end when said tubular member is in use, a second end which is a bottom end when said tubular member is in use, and a longitudinal axis which extends between the first end of the tubular side wall and the second end of the tubular side wall, the tubular side wall being open adjacent to the first end and adjacent to the second end to define a bore through the tubular side wall that extends from the first end of the tubular side wall to the second end of the tubular side wall, (2) a first wing which is unitary with the second end of the tubular side wall and which extends outwardly from the tubular side wall and which is slidably received in the first channel when said tubular member is in use, and (3) a second wing which is unitary with the second end of the tubular side wall and which extends outwardly from the tubular side wall and which is slidably received in the second channel when said tubular member is in use; and (c) a handle pivotally attached to said tubular member adjacent to the first end of the tubular side wall.

2. A trash receptacle unit comprising:

(a) a base member which includes (1) a U-shaped body having (A) a top surface, (B) a first end wall, and (C) a second end wall, (2) a first wing which includes a portion that extends over the top surface from the first end wall toward the second end wall, (3) a first channel defined between the top surface and the portion of the first wing that extends over the top surface toward the second end wall, (4) a second wing which includes a portion that extends over the top surface from the second end wall toward the first end wall, and (5) a second channel defined between the top surface and the portion of the second wing that extends over the top surface toward the first end wall;

(b) a tubular member which is releasably mountable on the base member when in use and which includes (1) a tubular side wall having a top end, a bottom end, and a bore therethrough that extends from the top end of the tubular side wall to the bottom end of the tubular side wall, (2) a first wing which extends outwardly from the bottom end of the tubular side wall, the first wing being slidably receivable in the first channel when the tubular member is in use, and (3) a second wing which extends outwardly from the bottom end of the tubular side wall, the second wing being slidably receivable in the second channel when the tubular member is in use, and (c) a handle pivotally attached to the tubular member adjacent to the top end of the tubular side wall.

* * * * *